United States Patent [19]

Shoji et al.

[11] 4,454,022

[45] Jun. 12, 1984

[54] DECOKING METHOD

[75] Inventors: Yoshihiko Shoji, Kamisu; Norio Kaneko; Kazuo Kimura, both of Ibaraki, all of Japan

[73] Assignee: Agency of Industrial Science & Technology, Tokyo, Japan

[21] Appl. No.: 442,235

[22] Filed: Nov. 16, 1982

[30] Foreign Application Priority Data

Nov. 18, 1981 [JP] Japan ..... 56-183846

[51] Int. Cl.[3] ..... C10G 9/16

[52] U.S. Cl. ..... 208/48 R; 208/127; 585/950

[58] Field of Search ..... 208/48 R, 127, 128, 208/129; 134/22.1, 22.11, 22.12, 22.18, 25.1, 39; 585/950

[56] References Cited

U.S. PATENT DOCUMENTS

| | | | |
|---|---|---|---|
| 2,563,085 | 8/1951 | Utsinger | 208/48 R |
| 3,507,929 | 4/1970 | Happel et al. | 208/48 R |
| 4,049,540 | 9/1977 | Ueda et al. | 208/127 |
| 4,049,541 | 9/1977 | Nakagawa et al. | 208/127 |
| 4,220,518 | 9/1980 | Uchida et al. | 208/127 |
| 4,259,177 | 3/1981 | Ueda et al. | 208/127 |

*Primary Examiner*—Delbert E. Gantz
*Assistant Examiner*—Anthony McFarlane
*Attorney, Agent, or Firm*—Stephen F. K. Yee

[57] ABSTRACT

Coke deposited within the gas passages of a dual tower type, fluidized bed apparatus for thermally cracking hydrocarbon oils is removed by combustion through contact with a stream of an oxygen-containing, high temperature combustion gas without a need to disjoint the apparatus. The apparatus is comprised of heating and cracking towers each adapted for containing a mass of fluidized solid particles continuously recirculating between the two towers. In one embodiment, all of the solid particles are discharged from the apparatus and a stream of the oxygen-containing combustion gas, produced in a combustion furnace connected to the heating tower, is allowed to pass through the gas passages.

3 Claims, 1 Drawing Figure

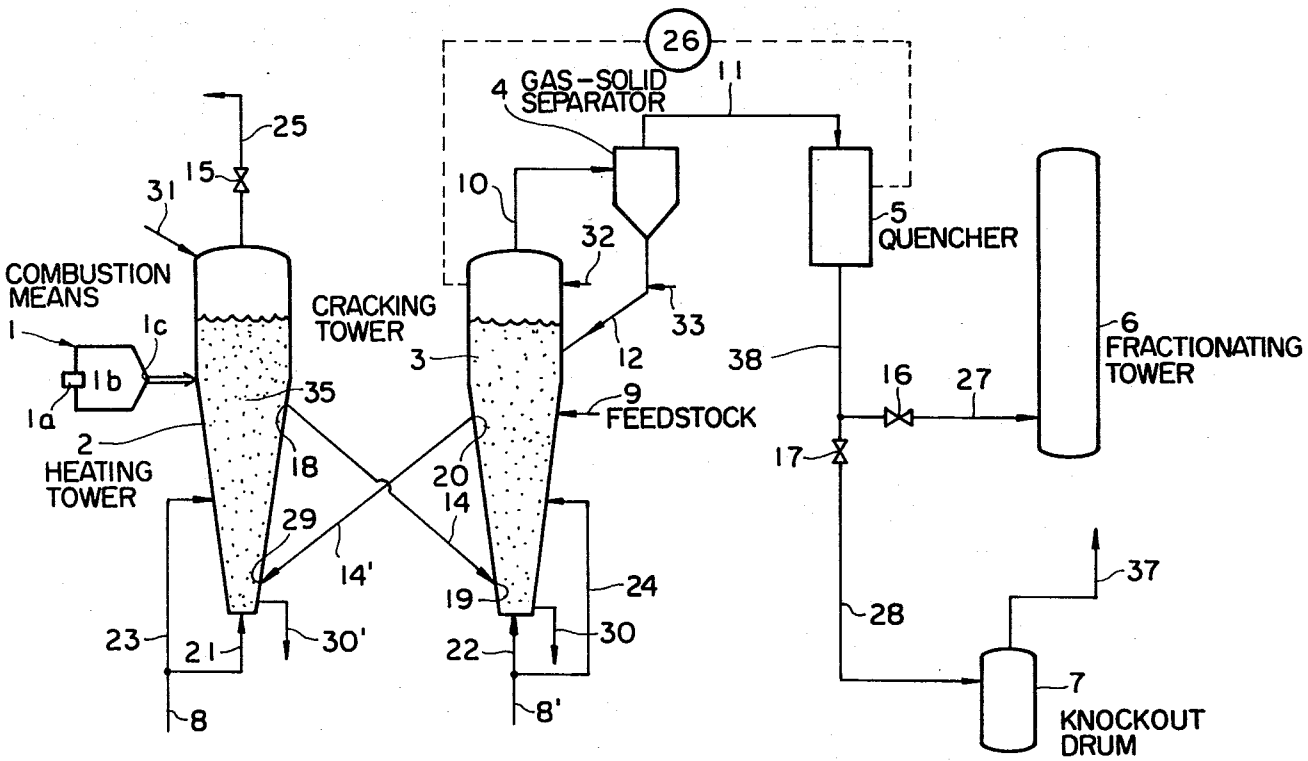
FRACTIONATING TOWER
6
KNOCKOUT DRUM
7
37
QUENCHER
5
27
16
28
17
38
26
11
GAS-SOLID SEPARATOR
4
33
12
9
FEEDSTOCK
32
24
30
8'
10
20
14
19
22
3
CRACKING TOWER
14'
30'
35
18
29
25
15
21
8
31
23
COMBUSTION MEANS
1c
1b
1a
1
2
HEATING TOWER

DECOKING METHOD

BACKGROUND OF THE INVENTION

This invention relates to a method of removing coke deposited within gas passages of an apparatus for the thermal cracking of hydrocarbons.

For thermally cracking hydrocarbon oils such as crude oils, reduced crude oils and residual oils, it is known to use a dual tower type apparatus composed of heating and cracking towers each containing a fluidized bed of solid particles continuously recirculating between the two towers. In such an apparatus, the feedstock is fed to the cracking tower where it is subjected to thermal cracking conditions by contact with the heated, fluidized soild particles. The cracked product is withdrawn overhead from the cracking tower for recovery while the solid particles are introduced into the heating tower, where they are heat-regenerated by contact with a combustion gas introduced into the heating tower from a combustion furnace provided adjacent thereto. The thus heat-regenerated solid particles are then recycled to the cracking tower.

When the apparatus is operated for a certain period of time, for example for five weeks, there arises a need to conduct a decoking operation since a large amount of coke is deposited and accumulated within the gas passages downstream of the cracking tower, such as pipes, cyclone, quenching device, etc. In such a case, it has been the general practice to disjoint the apparatus for the removal of the coke deposited on the inside surfaces of the pipes, cyclone and other parts, the separated parts being assembled after being cleaned of coke. The decoking of the thus separated parts are generally effected physically using suitable cleaning devices and, thus, is very troublesome. Moreover, since the apparatus is generally high and heavy, the disjointing and assembling procedures themselves are also time-consuming. Therefore, the conventional decoking method is disadvantageous from an economic point of view.

There is known a so-called steam-air decoking method in which a hot combustion gas and steam are alternately allowed to flow through the gas passages of the apparatus so that the coke deposited within the gas passages is subjected to alternate heating and cooling, whereby the coke is spalled. The spalled coke pieces are carried with the stream of the high speed steam. This method does not require disjointing work. However, this method is applicable only to apparatuses of a small diameter cracking tube formed of a material of a large thermal expansion coefficient, such as a metal, since such an apparatus alone enables easy exfoliation of the coke from the surfaced of the tube and high speed flow of steam. The steam-air decoking method cannot be applied to the above-mentioned dual tower type cracking apparatus which is generally made of an inorganic refractory material and which is large in pipe diameter.

BRIEF SUMMARY OF THE INVENTION

It is, therefore, an object of the present invention to provide an economical method capable of removing coke deposited on the inside wall of a dual tower-type apparatus for cracking hydrocarbons efficiently without a need to disjoint the apparatus.

BRIEF DESCRIPTION OF THE DRAWING

Other objects, features and advantages of the present invention will become apparent from the detailed description of the invention which follows when considered in light of the accompanying drawing, in which the sole FIGURE is a schematic illustration of a dual tower-type apparatus for thermally cracking hydrocarbon oils.

DETAILED DESCRIPTION OF THE INVENTION

Referring to FIGURE, the reference numerals 2 and 3 denote a heating tower and a cracking tower, respectively, each of which has generally a tubular shape. The heating tower 2 and the cracking tower 3 are each adapted for enclosing a mass of solid particles 35 acting as a heat transfer medium.

The heating tower 2 is provided with an opening 29 at its lower position and an opening 18 at a position above the opening 29. The cracking tower 3 is also provided with an opening 19 at its lower position and an upper opening 20 at a position above the opening 19. A first transport leg or pipe 14 is connected at one end to the upper opening 18 of the heating tower 2 and at its other end to the lower opening 19 of the cracking tower 3 so that the solid particles may descend through the transport leg 14 by gravity. Similarly, a second transport leg or pipe 14' extends between the opening 20 of the cracking tower 3 and the lower opening 29 of the heating tower 2 so that the solid particles may flow downward through the leg 14' by gravity.

First and second supply means are provided in the heating and cracking towers 2 and 3, respectively, for supplying a fluidizing gas to respective towers therethrough. Thus, a first fluidizing gas is fed from a line 8 and introduced into the heating tower 2 through a line 21 branched from the line 8 so that the solid particles in the heating tower 2 may be maintained in a fluidized state. A second fluidizing gas which may be the same as or different from the first fluidizing gas is fed from a line 8' and introduced into the cracking tower 3 via line 22 branched from the line 8' so that the solid particles contained in the cracking tower may be maintained in a fluidized state. Lines 23 and 24, branched from the lines 8 and 8', respectively, open into the heating and cracking towers 2 and 3, respectively, for the supply of the fluidizing gases therethrough to maintain the respective fluidized beds in a suitable fluidizing condition.

Provided adjacent to the heating tower 2 is a combustion means 1 including a burner 1*a*, a combustion furnace 1*b* and a combustion gas discharge port 1*c* connected to the heating tower 2, so that the combustion gas produced by the combustion means 1 is fed to the heating tower 2 for heating the solid particles contained in the heating tower 2. The combustion gas and the first fluidizing gas are discharged from the heating tower 2 through a discharge conduit means which includes a discharge pipe 25 and a valve 15 connected to the top of the heating tower 2.

Connected to the middle portion of the cracking tower 3 is a feed means 9 through which a hydrocarbon feedstock is streamed into the cracking tower 3 for cracking treatment therein. A discharge line 10 is connected to the top of the cracking tower 3 through which a gas containing the cracked gaseous product and the second fluidizing gas is discharged from the cracking tower 3. Indicated as 4 and 5 are respectively a gas-solid separator such as a cyclone, and a cooling means such as a quencher connected with each other by a pipe 11. Indicated as 12 is a solids return line through which the solids separated in the cyclone 4 are recycled to the cracking tower 3. The quencher 5 has a cooled gas discharge line 38 which is divided into a line 27 connected to a fractionating tower 6 and a line 28 connected to a knockout drum 7. Selective introduction means such as valves 16 and 17 are provided between the quencher 5, and the fractionating tower 6 and the knockout drum 7 for selectively introducing the cooled gas from the quencher 5 into either the fractionating tower 6 or the knockout drum 7. Designated as 37 is a gas discharge line connected to the knockout drum 7 through which the gas supplied into the drum 7 is discharged after the removal of solids components entrained therein.

A conduit 30 and a conduit 31 is located adjacent to the lower portion of the cracking tower 3 and the heating tower 2, respectively, for the removal of the solid particles from each tower, and a line 31 is provided through which solid particles are introduced into the heating tower. Feed lines 32 and 33 are provided to introduce gas into the upper portion of the cracking tower 3, for purposes described below.

The thus constructed cracking apparatus is operated as follows. In start up, the lines 30 and 30' and the valve 16 are closed. A suitable amount of solid particles such as sand, coke, alumina or any other conventionally employed heat transfer medium is introduced through the line 31 into the heating and cracking towers 2 and 3. First and second fluidizing gases such as steam are fed to the lines 8 and 8', respectively. As a consequence, there is formed in each of the heating and cracking towers 2 and 3 a bed of fluidized solid particles which continuously recirculate between the heating and the cracking towers 2 and 3 through the first and second transport legs 14 and 14'.

Meanwhile, a fuel such as a fuel oil or a fuel gas is combusted in the combustion means 1 and the resulting high temperature combustion gas is fed to the heating tower 2 to heat the solid particles in the heating tower 2. The combustion gas after being contacted with the solid particles is discharged together with the first fluidizing gas through the valve 15 and the line 25.

A portion of the solid particles in the cracking tower 3 is continuously streamed downward through the second transport leg 14' by gravity and introduced into the lower portion of the heating tower 2, where the solid particles are heated by contact with the combustion gas supplied from the combustion means 1. A portion of the thus heat-regenerated solid particles is continously flown downward through the first transport leg 14 and is introduced into the cracking tower 3 for the utilization of the heat thereof for effecting the thermal cracking of the feedstock.

When the fluidized bed in the cracking tower 3 is heated to a temperature sufficient enough to effect the cracking operation, the valve 16 is opened and the valve 17 is closed. The hydrocarbon feedstock is then continuously fed through the feeding means 9 to the cracking tower 3 where it is subjected to thermal cracking conditions by contact with the solid particles which have been heated in the heating tower 2.

The gaseous cracking product is withdrawn from the cracking tower 3 together with the second fluidizing gas and is introduced into the gas-solid separator 4. The solids separated in the separator 4 are returned to the cracking tower 3 through the return line 12 while the gas is fed to the quencher 5. The cooled gas from the quencher 5 is introduced into the fractionating tower 6 through the line 27, thereby to obtain desired fractions. The knockout drum 7 connected to the line 28 branched from the line 38 serves to remove the solid particles entrained in the cooled gas from the quencher 5. During the start up operation, the cooled gas from the quencher 5 is introduced into the knockout drum rather than the fractionating tower 6. When the thermal cracking process reaches a steady state, the valve 17 is closed and the valve 16 is opened for introducing the cooled gas into the fractionating tower 6.

When the operation is continued for a long period of time, coke produced in the cracking step in the cracking tower 3 deposits on the inside wall of the gas passages such as the line 10, gas-solid separator 4, line 11, and quencher 5 so that it becomes impossible to continue the cracking operation in a stable manner. The accumulation of the coke may be detected by a differential indicator 26 provided to measure the difference in pressure between, for example, the cracking tower 3 and the quencher 5. Thus, when the differential indicator raises an alarm, the cracking operation is stopped to conduct decoking operation.

In one method according to the present invention, decoking is conducted as follows:

(a) The feed of the hydrocarbon feedstock is stopped.

(b) The valves 15 and 16 are closed and the valve 17 is opened.

(c) Substantially all of the solid particles in the heating tower 2, cracking tower 3 and first and second transport legs 14 and 14' are discharged from the apparatus through the lines 30 and 30'.

(d) The combustion means 1 is operated to produce a high temperature, oxygen-containing combustion gas. The combustion gas generally has a temperature of 700°-2000° C., preferably 800°-1500° C. and an oxygen content of 0.1-15 vol %, preferably 1-10 vol %. The oxygen-containing combustion gas may be produced by combustion of a fuel, such as a fuel oil or any other suitable fuel, with an excess air ratio.

As a result of the above operation, the high temperature oxygen-containing combustion gas in the combustion means 1 is allowed to pass through the heating tower 2, cracking tower 3, line 10, gas-solid separator 4, line 11 and quencher 5 so that the coke deposited within the gas passages is decomposed by combustion. The decoking operation is generally continued until the concentration of carbon dioxide in the gas discharged through the line 37 decreases to less than about 0.1 vol. %.

In an alternative embodiment of the present invention, the decoking is performed as follows:

(a) The feed of the hydrocarbon feedstock is stopped.

(b) The valve 16 is closed and the valve 17 is opened.

(c) The combustion means 1 is operated to produce high temperature combustion gas for heating the solid particles in the heating tower 2 through direct contact therewith.

(d) The first and second fluidizing gases, which may be the same as or different from with each other, are fed to the lines 8 and 8', respectively, to maintain the solid particles in each tower in a fluidized state and in continuous recirculation between the heating and cracking towers 2 and 3 through the transport legs 14 and 14', whereby the temperature of the solid particles in the cracking tower 3 is maintained generally in the range of 600°-800° C.

(e) An oxygen-containing gas such as air is fed to the cracking tower 3. The content of the oxygen in the oxygen-containing gas is generally such that the oxygen concentration in the tower 3 is maintained in the range of 0.1–15 vol. %. The oxygen-containing gas may be supplied through the line 22, 24 or 9. It is possible to provide, as shown in the drawing, one or more gas feed lines 32 and 33 for the introduction of the oxygen-containing gas therethrough into the upper space of the cracking tower 3. When the apparatus is in the thermal cracking operation, the gas feed lines 32 and 33 may be closed or supplied with steam.

In the above-mentioned alternative embodiment, if the solid particles are formed of a combustible material such as coke, then it is necessary to minimize the contact between the solid particles and oxygen, since otherwise the oxygen is consumed by reaction with the solid particles and the decoking cannot be achieved effectively. In such a case, therefore, the combustion in the combustion means 1 is conducted so that the resulting combustion gas is substantially free of oxygen. Further, the oxygen-containing gas should be fed to the cracking tower 3 at a position over the top surface of the bed of the fluidized solid particles. To achieve this purpose, it is preferred that the level of the fluidized bed in the cracking tower 3 be maintained as low as possible, i. e. adjacent to the opening 20. The oxygen-containing gas is supplied from the line 32 and/or 33. The lowering of the height of the fluidized bed in the cracking tower 3 can be done by increasing the pressure in the cracking tower 3 by controlling the degree of opening of the valves 15 and/or 17. For the purpose of minimizing the discharge of fine particulate of the solid particles from the cracking tower 3, it is preferable to decrease the velocity of the second fluidizing gas supplied to the cracking tower 3. The velocity may be decreased to any extent so far as the recirculation of the solid particles between the heating and cracking towers 2 and 3 is maintained.

According to the method of the present invention, the decoking can be effected without disjointing the cracking apparatus and without using any particular equipment. Thus, as soon as the decoking operation is terminated, it is possible to resume the cracking operation.

The following examples will further illustrate the present invention.

EXAMPLE 1

A heavy hydrocarbon oil was thermally cracked with the use of the apparatus shown in the accompanying drawing. Coke particles having diameters ranging from 0.2 to 2.0 mm were used as a heat transfer medium. The apparatus was operated under the following conditions:

Combustion means 1: The combustion gas had a temperature of about 2000° C. at the furnace outlet and contained substantially no oxygen.

Heating tower 2: The coke particles have a temperature of about 800° C.

Cracking tower 3: The temperature of coke particles was 750° C.

The feedstock oil was fed at a rate of 5000 Kg/H. The cracking operation had been continued for about 1000 hours when the differential indicator 26 showed the need to perform decoking. Thus, the feed of the feedstock (line 9) was stopped. The entire amount of the coke particles was discharged from the apparatus. The valves 15 and 16 were closed and the valve 17 was opened. The combustion means 1 was then operated under the following conditions:

Fuel: A fuel gas was fed at a rate of 170 $Nm^3/H$ for combustion.

Combustion air: Supplied at a rate of 2500 $Nm^3/H$.

Steam: Supplied at a rate of 2300 $Nm^3/H$.

The combustion gas had a temperature of 810° C. at the outlet of the combustion furnace and an oxygen content of about 2.5 vol %. About 12 hours after the initiation of the decoking operation, the temperature at the top of the cracking tower was found to be stabilized at 700° C. The decoking operation had been further continued for about 72 hours when the concentration of carbon dioxide in the gas discharged from the knockout drum 7 was reduced to about 0.1 vol %. Then the feed of the fuel to the burner was stopped. The temperature of the cracking tower 3 was lowered to room temperature after about 12 hours from the stop of the feed of the fuel. The inspection of the inside wall surfaces of the apparatus revealed that the decoking was satisfactorily accomplished.

EXAMPLE 2

The thermal cracking operation in Example 1 was repeated in the same manner as described therein. After about 1000 hour cracking process, coke was found to accumulate within the gas passages of the apparatus in a significant amount. Thus, the feed of the feedstock (line 9) was stopped, and the valve 17 was opened and the valve 16 was closed. The decoking was conducted under the following conditions:

Combustion means 1: A fuel gas was fed to the burner and combusted at a rate of 190 $Nm^3/H$ with combustion air of 1900 $Nm^3/H$.

Heating tower 2: The temperature of the coke particles was 780° C.

Cracking tower 3: Steam was fed in an amount of 1500 Kg/H through the line 8'. Air was fed at a rate of 800 $Nm^3/H$ from the line 32 and 200 $Nm^3/H$ from the line 33.

In the initial stage of the decoking operation, fine coke particles in the cracking tower 3 was entrained in the gas withdrawn from the tower 3 and burnt in the upper portion of the tower 3. Therefore, the oxygen concentration in the gas flowing through the line 37 was 3%. After about 12 hours from the commencement of the decoking operation, the oxygen concentration was increased to about 5%. The decoking had been continued for about 72 hours when the oxygen concentration and the carbon dioxide concentration at the line 37 were found to be about 6% and about 0.1%, respectively, indicating the completion of the decomposition of the coke accumulated within the gas passages of the apparatus. The inspection within the apparatus after the decoking operation revealed that the decoking was ended with satisfactory results.

For the purpose of comparison, decoking was carried out manually after disjointing the apparatus. The disjointing and the assembling works required a crane and other devices. A total of 11 days were required for completing the decoking work with about 8 workers per day in average.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embranced therein.

We claim:

1. A method of removing coke deposited within the gas passages of a dual-tower fluidized bed-type apparatus for thermally cracking hydrocarbons, said apparatus including:

heating and cracking towers, each adapted for enclosing a bed of fluidized solid heat exchange particles of a combustible material;

means provided in each of the heating and cracking towers for supplying therethrough a gas to respective towers to maintain the solid particles contained therein in a fluidized state;

first and second transport means, each extending between the heating and cracking towers such that the fluidized particles are in continuous recirculation between said towers, successively up the heating tower, down the first transport means, up the cracking tower and down the second transport means;

a discharge conduit means opening into the top of the heating tower for discharging a controlled amount of the gas in the heating tower therethrough;

a combustion means for heating a gas and having a combustion gas discharge port connected to the heating tower for heating with the combustion gas the fluidized solid particles in the heating tower;

means connected to the cracking tower for feeding the hydrocarbons to the cracking tower;

a gas-solid separating means connected to the top of the cracking tower for separating solids contained in the gas flow introduced thereinto from the cracking tower;

a cooling means connected to the gas-solid separating means for quenching the gas flow introduced thereinto from the gas-solid separating means;

a fractionating tower for fractionating the cooled gas;

a knockout drum for removing the solid particles entrained in the cooled gas from the cooling means; and control means for selectively introducing the cooled gas from the cooling means into either the fractionating tower or the knockout drum;

whereby the hydrocarbons supplied to the cracking tower through the hydrocarbon feed means are cracked by contact with a bed of heated, fluidized solid particles to form a gas product, the solid particles being introduced into the heating tower through the second transport means and heat-regenerated therein by contact with the combustion gas from the combustion means, the heated solid particles being recycled to the cracking tower through the first transport means for the utilization of their heat for effecting the cracking, said gas product being discharged from the cracking tower and passed successively through the gas-solid separating means, cooling means and fractionating tower, and wherein the gas passages in and upstream of the cooling means occasionally have to be cleaned of coke deposited therein; said method comprising:

stopping the feed of the hydrocarbons to the cracking tower;

operating the combustion means to heat the solid particles in the heating tower, the combustion means being operated so that the resulting combustion gas is substantially free of oxygen;

supplying a gas through each of the first and second gas supplying means to maintain the solid particles in the heating tower and the cracking tower in a fluidized state and in continous recirculation between the heating and cracking towers through the first and second transport means;

supplying an oxygen-containing gas to a space above the fluidized bed in the cracking tower; and operating the selective introduction control means to allow the cooled gas from the cooling means to stream exclusively into the knockout drum, so that the oxygen-containing gas introduced into the cracking tower is allowed to pass through the gas passages and flow into the knockout drum, whereby the coke deposited within the gas passages is decomposed by combustion.

2. A method as set forth in claim 1, wherein the level of the fluidized bed in the cracking tower is lowered by increasing the pressure within the cracking tower.

3. A method as set forth in claim 1, wherein the velocity of the second fluidizing gas supplied to the cracking tower is decreased.

* * * * *